US008741106B2

(12) United States Patent
Murakami et al.

(10) Patent No.: US 8,741,106 B2
(45) Date of Patent: Jun. 3, 2014

(54) PRESS BELT AND SHOE PRESS ROLL, AND MANUFACTURING METHOD OF PRESS BELT

(75) Inventors: Tetsuya Murakami, Hirakata (JP); Hiroyuki Yasukawa, Hirakata (JP); Takahisa Hikida, Hirakata (JP)

(73) Assignee: Yamauchi Corporation, Osaka (JP)

( * ) Notice: Subject to any disclaimer, the term of this patent is extended or adjusted under 35 U.S.C. 154(b) by 0 days.

(21) Appl. No.: 13/818,925

(22) PCT Filed: Aug. 29, 2011

(86) PCT No.: PCT/JP2011/069398

§ 371 (c)(1),
(2), (4) Date: Feb. 25, 2013

(87) PCT Pub. No.: WO2012/029693

PCT Pub. Date: Mar. 8, 2012

(65) Prior Publication Data

US 2013/0146243 A1 Jun. 13, 2013

(30) Foreign Application Priority Data

Sep. 2, 2010 (JP) ..... 2010-196510

(51) Int. Cl.
*D21G 9/00* (2006.01)

(52) U.S. Cl.
USPC ..... 162/289

(58) Field of Classification Search
USPC ..... 162/289, 358.1, 358.2, 358.3, 358.4; 428/157
See application file for complete search history.

(56) References Cited

U.S. PATENT DOCUMENTS

| | | | | |
|---|---|---|---|---|
| 4,330,023 | A * | 5/1982 | Cronin | 162/358.4 |
| 5,943,951 | A * | 8/1999 | Muellner et al. | 100/37 |
| 6,709,552 | B2 * | 3/2004 | Sakuma et al. | 162/358.4 |
| 6,736,939 | B2 * | 5/2004 | Watanabe | 162/358.3 |
| 7,611,608 | B2 * | 11/2009 | Hikida | 162/358.4 |
| 7,909,965 | B2 * | 3/2011 | Yazaki et al. | 162/358.4 |
| 2002/0028317 | A1 * | 3/2002 | Sakuma et al. | 428/157 |
| 2004/0112561 | A1 * | 6/2004 | Watanabe et al. | 162/358.3 |
| 2004/0173275 | A1 * | 9/2004 | Matuschczyk et al. | 139/383 A |
| 2005/0145360 | A1 * | 7/2005 | Hikida | 162/358.4 |
| 2009/0050283 | A1 * | 2/2009 | Hikida | 162/358.1 |

FOREIGN PATENT DOCUMENTS

| | | | |
|---|---|---|---|
| JP | 2000-017594 | A | 1/2000 |
| JP | 2003-306882 | A | 10/2003 |
| JP | 2006-274448 | A | 10/2006 |
| JP | 2008-285784 | A | 11/2008 |
| WO | WO 2007/094346 | A1 | 8/2007 |

OTHER PUBLICATIONS

International Search Report for PCT/JP2011/069398 mailed Nov. 22, 2011.

* cited by examiner

*Primary Examiner* — Mark Halpern
(74) *Attorney, Agent, or Firm* — Ditthavong Mori & Steiner, P.C.

(57) ABSTRACT

In a press belt (2), stepped portions are formed between an outer peripheral surface of a central region (A) and outer peripheral surfaces of end-corresponding regions (B) located so as to corresponding to both ends in a lateral direction of a press roll (1) or a pressure shoe (3), so that the end-corresponding regions have a smaller thickness than the central region. The outer peripheral surfaces of the end-corresponding regions are finished so that a processing flaw depth becomes 10 μm or less.

8 Claims, 5 Drawing Sheets

PRESS BELT AND SHOE PRESS ROLL, AND MANUFACTURING METHOD OF PRESS BELT

This application is a 371 of PCT/JP2011/069398 filed 29 Aug. 2011.

TECHNICAL FIELD

The present invention relates to press belts and shoe press rolls that are used to press a target object in various industries such as a papermaking industry, a magnetic recording medium manufacturing industry, and a textile industry.

BACKGROUND ART

Belt press as a process of placing a belt-shaped target object on a press belt and pressing the target object between one pressing member located on the inner periphery of the press belt and the other pressing member located on the outer periphery of the press belt is used in various industries. As used herein, the "pressing member" refers to a press roll, a pressure shoe, etc. An example of the belt press is shoe press as dehydrating press in the papermaking industry.

The shoe press that is used in the papermaking industry will be briefly described as an example. The shoe press is a method of pressing (dehydrating) a target object (wet paper web) by placing the target object on the outer peripheral surface of a press belt and applying through the press belt a surface pressure to the target object between a press roll as external pressing means located on the outer periphery of the press belt and a pressure shoe as internal pressing means located on the inner periphery of the press belt. While roll press as press using two rolls applies a linear pressure to the target object, the shoe press can apply a surface pressure to the target object by using the pressure shoe having a predetermined width in a traveling direction. Accordingly, performing the dehydrating press by the shoe press is advantageous in that a nip width can be increased and hydrating efficiency can be enhanced.

In order to make the shoe press compact, shoe press rolls assembled in a roll shape by covering a pressure shoe as internal pressing means with a flexible cylindrical press belt (press jacket), as disclosed in, e.g., Japanese Unexamined Patent Application Publication No. S61-179359 (Patent Literature 1), have been widely used in the art.

In, e.g., the paper industry, the magnetic recording medium manufacturing industry, the textile industry etc., in order to improve quality of the target object, the shoe press may also be performed instead of the roll press or together with the roll press in processes other than the above dehydration process, such as a calendering process that is performed to make the surface of a target object smooth and glossy. Characteristics that are commonly required for the press belts include strength, abrasion resistance, flexibility, and impermeability to water, oil, gas, etc. Polyurethane that is obtained by causing reaction between urethane prepolymer and a curing agent is commonly used for the press belts as a material having these characteristics. However, since the press belts, in particular shoe press belts, are repeatedly subjected to severe bending and pressing, cracking tends to occur in the outer peripheral surfaces of the press belts, causing a serious problem in terms of durability. In particular, pressing means such as a shoe has inflection points at its ends where the pressure is released. Thus, the press belt portions located in the ends tend to be intensively subjected to bending and stress, and thus are susceptible to cracking.

In Japanese Unexamined Patent Application Publication No. 2005-97806 (Patent Literature 1), the applicant proposed a press belt having a shape designed in view of the above problems. This press belt includes end-corresponding regions corresponding to both ends in a lateral direction of pressing means and having a small thickness, and a central region located between the end-corresponding regions and having a larger thickness than the end-corresponding regions. The end-corresponding regions of the press belt are subjected to stress in longitudinal and lateral directions when in use, and thus are subjected to torsional stress. According to this improved press belt, the thickness of the end-corresponding regions is reduced to increase flexibility of these regions. Thus, when subjected to torsional stress, the end-corresponding regions absorb the torsional stress by flexural deformation, whereby cracking can be effectively suppressed.

CITATION LIST

Patent Literatures

PTL 1: Japanese Unexamined Patent Application Publication No. S61-179359

PTL 2: Japanese Unexamined Patent Application Publication No. 2005-97806

SUMMARY OF INVENTION

Technical Problem

The press belt disclosed in Japanese Unexamined Patent Application Publication No. 2005-97806 has accomplished certain results such as being able to retard cracking. However, further improvement is desired.

In order to obtain uniform thickness accuracy, press belts are normally subjected to wet grinding using a grinding wheel as final surface finishing after forming process. In the press belt disclosed in Japanese Unexamined Patent Application Publication No. 2005-97806 as well, the surface of the central region having a large thickness and the surfaces of the end-corresponding regions having a small thickness are finally finished by wet grinding using a grinding wheel.

One of the inventors examined cracking in press belts shaped as disclosed in Japanese Unexamined Patent Application Publication No. 2005-97806, after using these press belts. The result showed that in many cases, cracks originated from deep grinding flaws or scratches made by grinding using a grinding wheel and extending in a circumferential direction (belt traveling direction). Such cracks were formed intensively in the end-corresponding regions having a small thickness.

It is an object of the present invention to provide a press belt having improved durability by reducing the thickness of end-corresponding regions of the press belt and eliminating grinding flaws and scratches in the surfaces of the end-corresponding regions.

Solution to Problem

A press belt according to the present invention is a press belt that is used in a press apparatus including a rotating endless press belt and pressing means located on an inner periphery and/or an outer periphery of the press belt, and that includes: end-corresponding regions located so as to correspond to both ends in a lateral direction of the pressing means; and a central region located between the end-corresponding regions. Stepped portions are formed between an outer peripheral surface of the central region and outer peripheral surfaces of the end-corresponding regions so that the end-corresponding regions have a smaller thickness than the central region. The press belt is characterized in that the outer peripheral surfaces of the end-corresponding regions are finished so that a processing flaw depth becomes 10 μm or less. In the present invention, the difference in level as measured in the range of a measurement field of a scanning laser microscope is defined as the processing flaw depth. A press belt having a processing flaw depth of 10 μm or less had satisfactory breaking strength and also had a satisfactory flex test result.

Wet grinding using a grinding wheel causes deep, sharp grinding flaws in places on the surface of a press belt. On the other hand, cutting using a sharp cutting tool and buffing using a soft material (cloth, leather, etc.) are less likely to cause deep processing flaws on the surface of the press belt. Accordingly, in the present invention, the surfaces of the end-corresponding regions having a small thickness and being susceptible to cracking are preferably finished by cutting and/or buffing so as to eliminate deep, sharp processing flaws serving as origins of cracking. The processing flaw depth of 10 μm or less can also be achieved by precision processing using dry grinding or film polishing, in addition to cutting and buffing.

The surfaces of the end-corresponding regions may be subjected to cutting or buffing after being grounded with a grinding wheel. Even if deep, sharp grinding flaws are produced by the grinding, the cutting or buffing is performed to reach about the depth of the grinding flaws.

The cutting is preferably performed by using a ring-shaped cutting tool. Since the ring-shaped cutting tool has a relatively large cutting width in the lateral direction, the processing time can be reduced, and sharpness of the cutting edge can be maintained for a long time.

In a preferred embodiment, the press belt further includes: a reinforcing layer; and an upper elastic layer. In this case, an outer peripheral surface of the upper elastic layer is shaped to have the stepped portions.

In a preferred embodiment, a large number of drain grooves extending in a belt traveling direction are formed in the outer peripheral surface of the central region of the press belt. However, no drain groove is formed in the outer peripheral surfaces of the end-corresponding regions. Since bottom ends of the drain grooves may serve as origins of cracking, it is preferable not to form any drain groove in the end-corresponding regions that are susceptible to cracking.

A shoe press roll according to the present invention includes: an outer jacket formed by an endless press belt having the above characteristics; and a pressure shoe as pressing means located on an inner periphery of the outer jacket.

A method for manufacturing a press belt according to the present invention includes the steps of forming stepped portions between an outer peripheral surface of a central region and outer peripheral surfaces of end-corresponding regions so that the end-corresponding regions have a smaller thickness than the central region; and after forming the stepped portions, finishing the outer peripheral surfaces of the end-corresponding regions so that a processing flaw depth becomes 10 μm or less.

According to the above method, no deep, sharp processing flaw remains in the surfaces of the end-corresponding regions. The finishing may be cutting using a cutting tool, or may be buffing using a buff made of cloth, leather, etc. Alternatively, both cutting and buffing may be performed. The finishing may be precision processing using dry grinding or film polishing. For example, it is also possible to perform buffing after cutting. Processing that is performed to reduce the thickness of the end-corresponding regions may be grinding using a grinding wheel, or may be cutting using a cutting tool.

Advantageous Effects of Invention

As used herein, the terms "traveling direction" and "lateral direction" refer to the traveling direction and the lateral direction of a target object, unless otherwise specified. The target object is a band-shaped material such as a wet paper web, a magnetic tape, or woven fabric, and is not particularly limited. The pressing means is a press roll, a pressure shoe, etc.

DESCRIPTION OF EMBODIMENTS

Embodiments of the present invention will be specifically described below with reference to the accompanying drawings.

Figure 1:
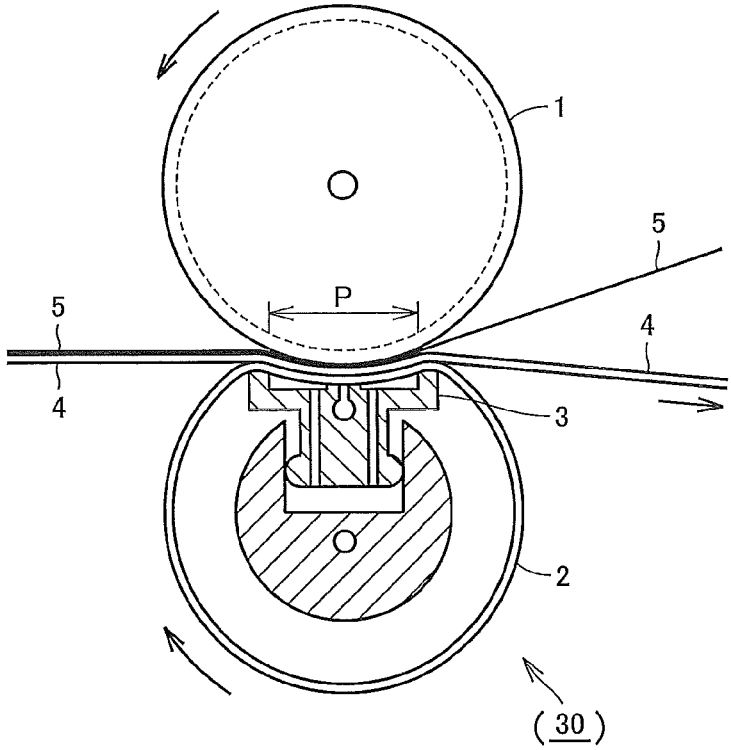
FIG. 1 is a diagram showing a section of a shoe press apparatus that is used in a pressing step of a paper machine, taken along a traveling direction.

FIG. 1 is a diagram showing a section of a shoe press apparatus that is used in a pressing step of a paper machine, taken along a traveling direction. The shoe press apparatus includes a press roll as pressing means 1, a press belt 2 facing the press roll 1, and a pressure shoe as pressing means 3 located on the inner periphery of the press belt 2. In the apparatus of FIG. 1, the pressure shoe 3 is covered with the press belt 2 and the press belt 2 is formed into a roll shape as an outer casing to configure a shoe press roll 30. However, the press belt 2 may not be formed into a roll shape, and may be used as an endless belt as it is. This type of press belt 2 typically has the following size. The width is 2 to 15 m, the perimeter is 1 to 30 m, and the thickness is 2 to 10 mm.

The press roll 1 is located on the outer periphery of the press belt 2, and functions as one pressing means. The pressure shoe 3 is located on the inner periphery of the press belt 2, and functions as the other pressing means. A wet paper web 5 as a target object is passed between the press belt 2 and the press roll 1 so as to be superposed on a felt 4. The outer peripheral surface of the press belt 2 is in direct contact with the felt 4.

Lubricant is supplied between the press belt 2 and the pressure shoe 3, so that the press belt 2 can slide on the pressure shoe 3. The press roll 1 drivingly rotates, and the press belt 2 driven rotates while sliding on the pressure shoe 3 due to frictional force between the press belt 2 itself and the felt 4 that is traveling.

The pressure shoe 3 is pressed against the press roll 1 from the inner periphery of the press belt 2, so that the wet paper web 5 is pressed and dehydrated with this pressing force. The surface of the pressure shoe 3 has a concave shape corresponding to the surface of the press roll 1. Accordingly, a pressing/dehydrating portion P having a large width in the traveling direction is formed between the press roll 1 and the press belt 2.

Figure 2:
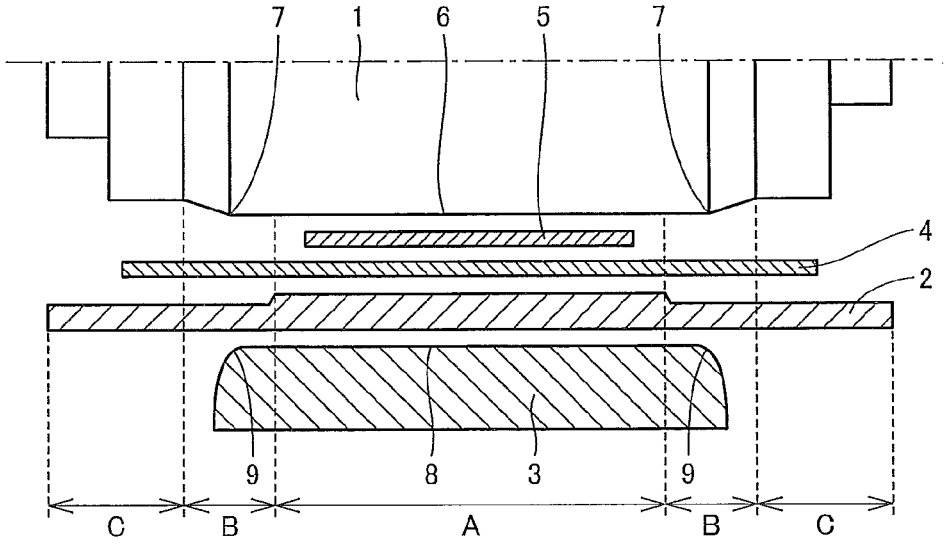
FIG. 2 is a sectional view of a main part, showing a section of a pressing/dehydrating portion P in FIG. 1, taken along a lateral direction.

FIG. 2 is a sectional view of a main part, showing a section of the pressing/dehydrating portion P in FIG. 1, taken along a lateral direction. As shown in FIG. 2, the press roll 1 and the pressure shoe 3 have predetermined lengths in the lateral direction. The press belt 2 includes a central region A, end-corresponding regions B, and endmost regions C. The end-corresponding regions B are regions corresponding to portions including both ends 7 of a pressing surface 6 of the press roll 1 and both ends 9 of a pressing surface 8 of the pressure shoe 3. The width of the pressure shoe 3 is typically equal to that of the press roll 1 as shown in FIG. 2, or smaller than that of the press roll 1. In the case where the width of the pressure shoe 3 is smaller than that of the press roll 1, the end-corresponding regions B are regions corresponding to portions including both ends 9 of the pressing surface 8 of the pressure shoe 3. The endmost regions C are located outside the end-corresponding regions B.

Figure 3:
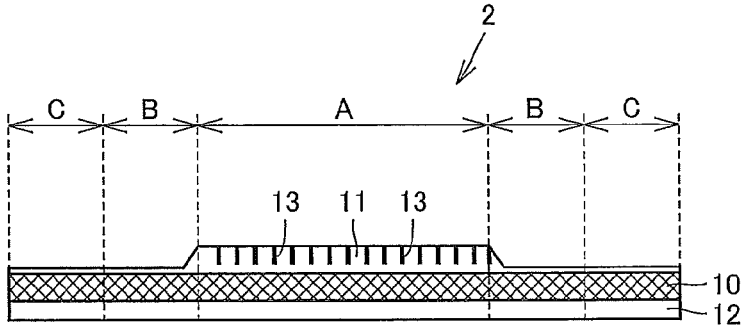
FIG. 3 is an illustrative sectional view showing a press belt according to an embodiment of the present invention.

FIG. 3 is a sectional view showing an example of the press belt 2. In one embodiment, the press belt 2 is formed by: a reinforcing layer 10 comprised of an endless reinforcing base material impregnated with an elastic material; an upper elastic layer 11 located on the outer peripheral surface of the reinforcing layer 10 and integral with the elastic material in the impregnated reinforcing base material of the reinforcing layer 10; and a lower elastic layer 12 located on the inner peripheral surface of the reinforcing layer 10 and integral with the elastic material in the impregnated reinforcing base material of the reinforcing layer 10. As another embodiment, the press belt may be the one having no reinforcing layer and comprised only of a resin.

Woven fabric comprised of organic fiber such as polyamide or polyester, etc. is used as the reinforcing base material of the reinforcing layer 10. The belt 2 is structured so that the entire belt 2 is integrally formed by an elastic material such as thermosetting polyurethane, and that the reinforcing base material is buried in the belt 2.

As shown in FIG. 3, a large number of drain grooves 13 extending in the traveling direction of the belt are formed in the outer peripheral surface of the upper elastic layer 11 in the central region A. The drain grooves 13 extend helically along the entire width of the press belt 2. No drain groove is formed in the outer peripheral surface of the upper elastic layer 11 in the end-corresponding regions B and the endmost regions C.

As shown in FIG. 3, stepped portions are formed between the outer peripheral surface of the central region A and the outer peripheral surfaces of the end-corresponding regions B so that the thickness of the end-corresponding regions B of the press belt 2 is smaller than that of the central region A thereof. In the illustrated embodiment, the thickness of the endmost regions C is the same as that of the end-corresponding regions B. However, as another embodiment, the thickness of the end-most regions C may be the same as that of the central region A.

Specific dimensions will be described below by way of example. As described above, the press belt 2 typically has a lateral dimension of 2 to 15 m, a perimeter of 1 to 30 m, and a thickness of 2 to 10 mm. In such a press belt 2, the lateral dimension of the end-corresponding region B is about 5 to 20 cm including a portion corresponding to the end 9 of the pressing surface 8 of the pressure shoe 3, the thickness of the upper elastic layer 11 is about 1.2 to 3 mm, the depth dl to the bottom end of the drain groove 13 is about 0.5 to 1.5 mm, and the height of the stepped portion is about 1.2 to 3 mm. The groove width of the drain groove 13 is about 0.6 to 1.2 mm, and the width of a land portion located between adjoining ones of the drain grooves 13 is about 0.9 to 3.6 mm.

An important characteristic of the embodiment shown in FIG. 3 is that the outer peripheral surfaces of the end-corresponding regions B of the press belt 2 are finished so that the processing flaw depth becomes 10 μm or less. It is more preferable that this finishing be performed so that the processing flaw depth becomes 5 μm or less. As used herein, the term "processing flaw" refers to a sharp flaw that is produced during processing such as surface grinding, and normally appears as a flaw that is longer in the longitudinal direction than in the lateral direction. The finishing is preferably performed by cutting or buffing. When manufacturing the press belt 2, the stepped portions are first formed between the outer peripheral surface of the central region A and the outer peripheral surfaces of the end-corresponding regions B so that the thickness of the end-corresponding regions B becomes smaller than that of the central region A. A processing method to reduce the thickness of the end-corresponding regions B may be grinding using a grinding wheel or cutting using a cutting tool. In the illustrated embodiment, the end-corresponding regions B and the endmost regions C are simultaneously processed to reduce their thicknesses. Although the regions to be surface-finished are the end-corresponding regions of the press belt 2, the central region A and the endmost regions C may also be finished similarly.

The difference in level as measured in the range of a measurement field of a scanning laser microscope is herein defined as the processing flaw depth. The finishing is performed until the processing flaw depth on the outer peripheral surfaces of the end-corresponding regions B becomes 10 μm or less. The scanning laser microscope used by the inventor is SLM700 made by Lasertec Corporation.

The end-corresponding regions B of the press belt 2 are repeatedly subjected to bending stress or torsional stress. According to the embodiment of the present invention, cracking in the end-corresponding regions B can be effectively suppressed for the following reasons. First, the thickness of the end-corresponding regions B is reduced to form the stepped portions between the outer peripheral surface of the central region A and the outer peripheral surfaces of the end-corresponding regions B. This avoids excessive stress concentration on the end-corresponding regions B and can increase flexibility of the end-corresponding regions B. Thus, even if the end-corresponding regions B are subjected to torsional stress, bending stress, etc., the torsional stress etc. can be absorbed to a certain extent by flexural deformation, whereby cracking can be suppressed.

Second, the outer peripheral surface of the press belt 2 located in the end-corresponding regions B is finished by a process such as cutting using a sharp cutting tool, buffing using soft cloth, leather, etc. so that the processing flaw depth becomes 10 μm or less. Accordingly, no deep, sharp processing flaw that may serve as an origin of cracking remains in the end-corresponding regions B.

Figure 4:
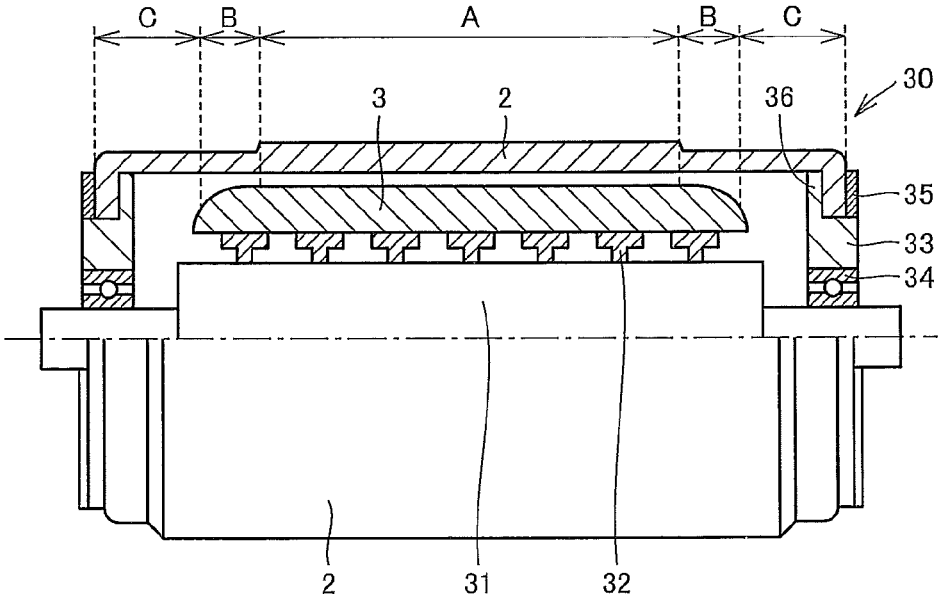
FIG. 4 is a diagram showing a section of a shoe press roll according to an embodiment of the present invention, taken along the lateral direction.

An embodiment of the shoe press roll 30 of the present invention will be described below with reference to FIG. 4. FIG. 4 is a diagram showing a section of the shoe press roll, taken along the lateral direction. The shoe press roll 30 is configured so that the pressure shoe 3 as the pressing means is covered with the press belt 2 and the press belt 2 is formed into a roll shape as an outer jacket.

The press shoe 3 is supported by a hydraulic cylinder 32 on a support shaft 31, and can press the press belt 2 upward. End discs 33 are rotatably supported on both ends of the support shaft 31 via bearings 34. Edges of the press belt 2 are bent radially inward on outer peripheries 36 of the end discs 33. Each of the bent portions of the edges of the press belt 2 is held between the outer peripheral portion of the end disc 33 and a ring-shaped fixing plate 35, and is fastened and fixed with a bolt etc. Lubricant is supplied between the press belt 2 and the pressure shoe 3. This allows the press belt 2 fixed to the end discs 33 to rotate while sliding on the pressure shoe 3.

Figure 5:
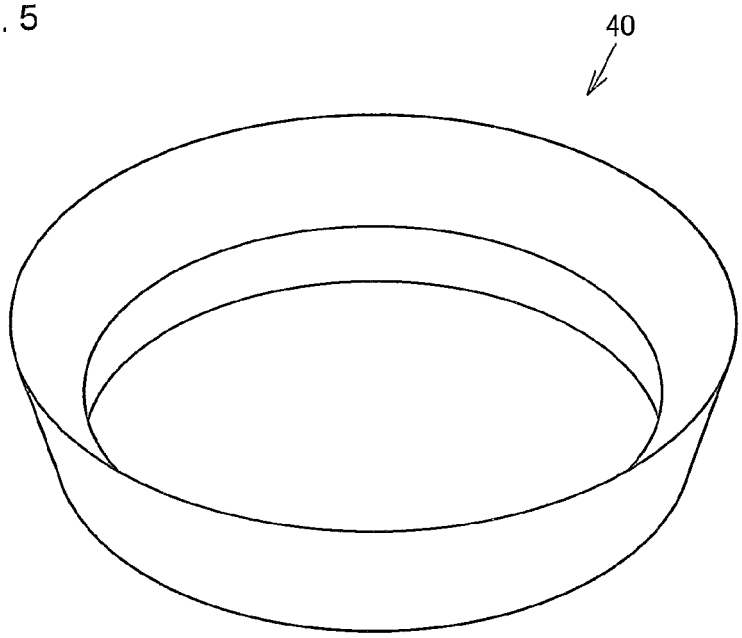
FIG. 5 is a perspective view showing a ring-shaped cutting tool.
Figure 6:
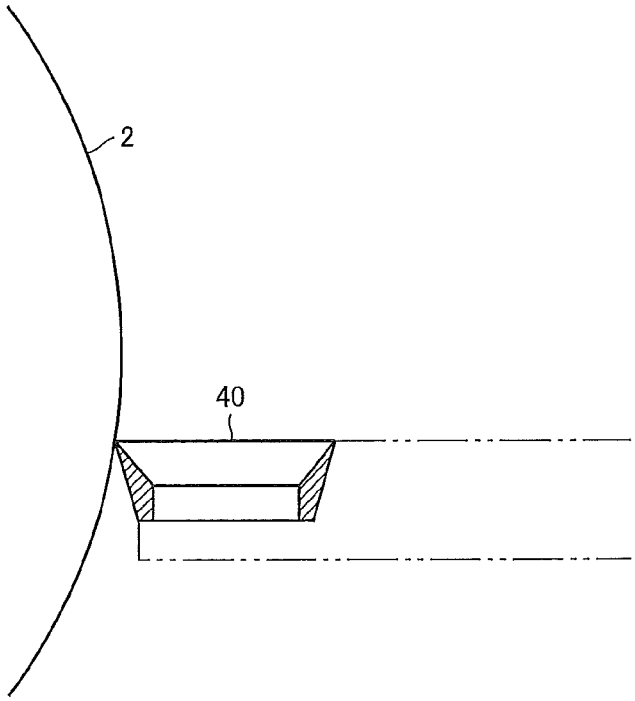
FIG. 6 illustrates the state where the surface of the press belt is cut with the ring-shaped cutting tool.

The cutting that is performed to finish the outer peripheral surfaces of the end-corresponding regions B of the press belt 2 preferably uses a ring-shaped cutting tool 40 having a ring shape as shown in FIG. 5. The diameter of the ring-shaped cutting tool 40 that is used is about 5 mm to 100 mm, and is preferably 10 mm to 50 mm. The rake angle of the ring-shaped cutting tool 40 is 5 to 45°, and is preferably 10 to 30°. Cemented carbide or high speed steel can be used as the material of the cutting tool 40, but longer life can be expected if cemented carbide is used. FIG. 6 illustrates the state where the outer peripheral surface of the rotating press belt 2 is cut with the ring-shaped cutting tool 40. Since the cutting tool 40 has a relatively large cutting width in the lateral direction, the processing time can be reduced, and sharpness of the cutting edge can be maintained for a long time.

Buffing is a method of polishing the surface of the press belt by using a buff made of cloth, leather, etc., together with an abrasive. The buffing gives the stain finished surface. Buffing the press belt by an amount corresponding to a thickness of about 0.2 mm after grinding with a grinding wheel eliminates flaws and scratches resulting from the grinding, and thus eliminates the portions serving as origins of cracking.

The inventor conducted various observations, experiments, or tests in order to verify the advantages of the present invention. The results will be described below.

[Comparison of Finished Surface Conditions]

Figure 7:
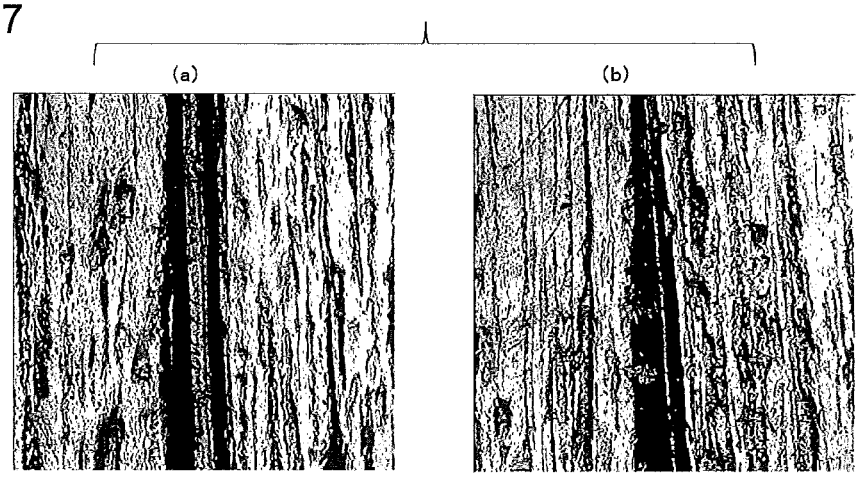
FIG. 7 shows images showing cracking in the surface of an upper elastic layer in the end corresponding regions of a press belt after use.

FIG. 7 shows images showing cracking in the surface of the upper elastic layer (thermosetting polyurethane) in the end-corresponding regions of a press belt after use. Wet grinding using a grinding wheel was used to finish the surface of the upper elastic layer in the end-corresponding regions. Both the portion shown in (a) and the portion shown in (b) had cracks originating from deep, sharp polishing scratches.

Figure 8:
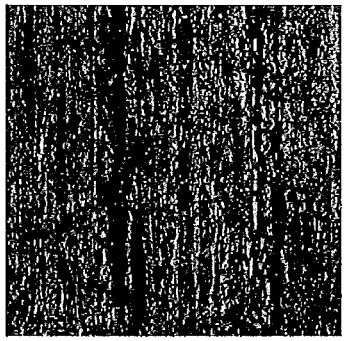
FIG. 8 shows an image of the surface of the upper elastic layer of a press belt after wet grinding.

FIG. 8 shows an image of the surface of the upper elastic layer (thermosetting polyurethane) of a press belt after wet grinding using a grinding wheel as in related art. The following measurement data was obtained by using the scanning laser microscope (SML700) made by Lasertec Corporation.

Magnification: 20×

Measurement field: 0.65 mm×0.65 mm

*Largest processing flaw

Difference in level: 20.860 μm (processing flaw depth: 20 μm)

Plane distance: 77.250 μm

Spatial distance: 80.017 μm

Angle: −15.111 deg

In the case of the grinding using a grinding wheel, other differences in level (processing flaw depth) of 40 μm and 100 μm were measured depending on the measurement location.

Figure 9:
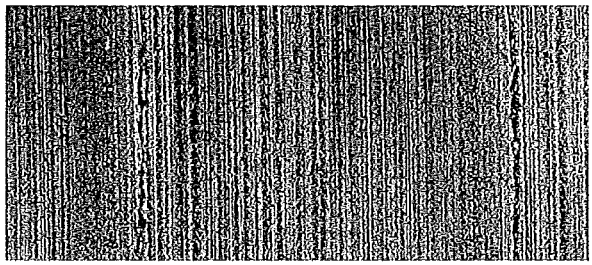
FIG. 9 shows an image of the surface of the upper elastic layer of a press belt after cutting.

FIG. 9 shows an image of the surface of the upper elastic layer (thermosetting polyurethane) of a press belt after cutting using a ring-shaped cutting tool. The following measurement data was obtained by using the scanning laser microscope (SML700) made by Lasertec Corporation.

Magnification: 20×

Measurement field: 0.65 mm×1.30 mm

*Largest processing flaw

Difference in level: 4.745 μm (processing flaw depth: 5 μm)

Plane distance: 25.500 μm

Spatial distance: 25.938 μm

Angle: −10.541 deg

Figure 10:
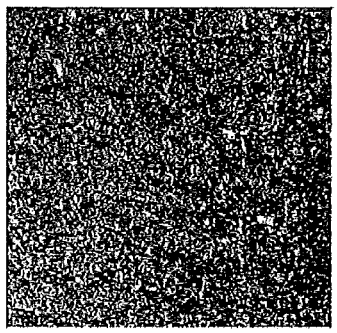
FIG. 10 shows an image of the surface of the upper elastic layer of a press belt after buffing.

FIG. 10 shows an image of the surface of the upper elastic layer (thermosetting polyurethane) of a press belt after buffing. The difference in level (flaw depth) measured by using the scanning laser microscope (SML700) made by Lasertec Corporation was several micrometers.

[De Mattia Flex Test]

Figure 11:
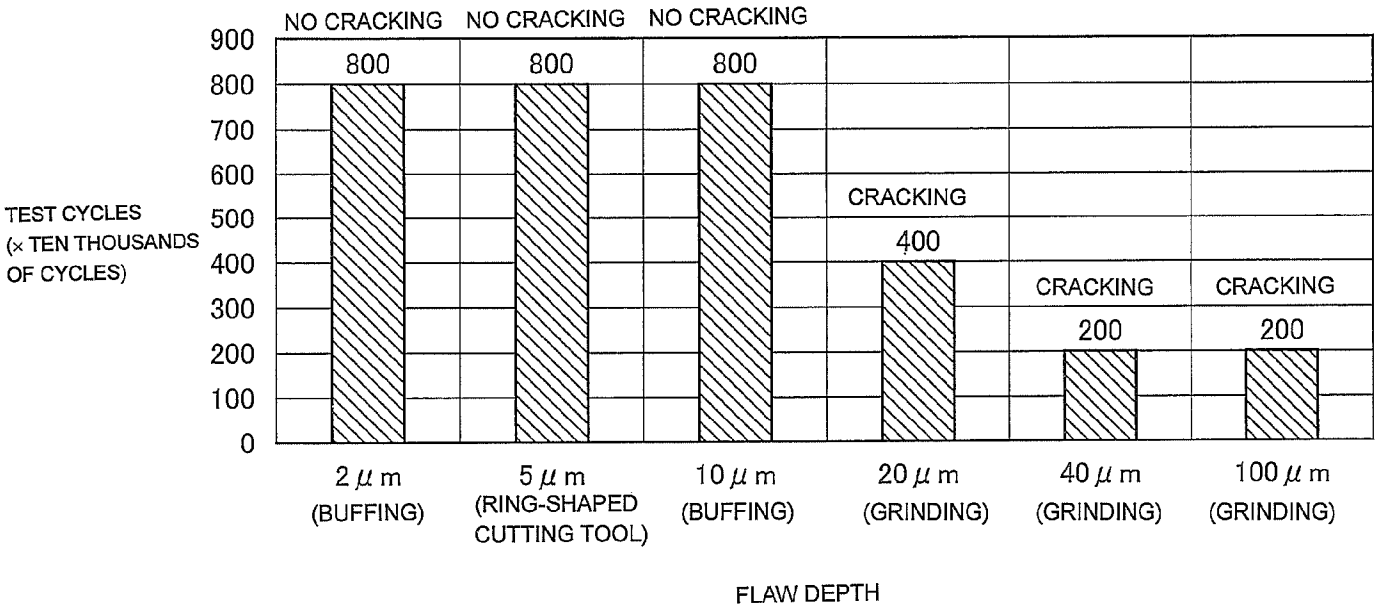
FIG. 11 shows the result of a De Mattia flex test.

A De Mattia flex test was conducted on six different samples produced by using different methods to finish the surface of the upper elastic layer. The wet grinding was used for three samples, and the processing flaw depths in these samples were 20 μm, 40 μm, and 100 μm, respectively. The cutting using a ring-shaped cutting tool was used for one sample, and the processing flaw depth in this sample was 5 μm. The buffing was used for two samples, and the processing flaw depths in these samples were 2 μm and 10 μm, respectively. A De Mattia flex tester shown in FIG. 1 of JIS K6260 was used. The test pieces were not those as defined in JIS, but rectangular sheets were cut out from the end-corresponding regions of actual press belts. The structure and dimensions of each test piece is as follows.

a) Structure: three-layer structure of the upper elastic layer (polyurethane having surface hardness of A95), the reinforcing layer (base cloth), and the lower elastic layer (polyurethane having surface hardness of A90)

b) Dimensions: length in the lateral direction of the press belt: 150 mm, length in the belt traveling direction: 20 mm, and thickness: 4.1 mm c) Thickness of each layer: upper elastic layer: 0.7 mm, reinforcing layer (base cloth): 2.3 mm, and lower elastic layer: 1.1 mm No groove as defined in JIS K6260 was formed in the central portions of the test pieces. FIG. 11 shows the flex test result.

In the sample pieces after the wet grinding with the processing flaw depth of 100 μm and 40 μm, cracking occurred after two millions of test cycles. In the sample piece after the wet grinding with the processing flaw depth of 20 μm, cracking occurred after four millions of test cycles. On the other hand, in the sample piece after the cutting with a ring-shaped cutting tool with the processing flaw depth of 5 μm, no cracking occurred even after eight millions of test cycles. Similarly, in the sample pieces after the buffing with the processing flaw depth of 2 μm and 10 μm, no cracking occurred even after eight millions of test cycles.

Although the embodiments of the present invention are described above with reference to the drawings, the present invention is not limited to the illustrated embodiments. Various modifications and variations can be made to the illustrated embodiments within a scope that is the same as, or equivalent to that of the present invention.

INDUSTRIAL APPLICABILITY

In the press belt of the present invention, cracking is less likely to occur in the end-corresponding regions that are conventionally susceptible to cracking. This allows the press belt to be used for a long term. Accordingly, the press belt of the present invention can be advantageously applied to press belts and shoe press rolls that are used to press a target object in various industries such as a papermaking industry, a magnetic recording medium manufacturing industry, and a textile industry.

REFERENCE SIGNS LIST

1 press roll
2 press belt
3 pressure shoe
4 felt
5 wet paper web
6 pressing surface
7 end
8 pressing surface
9 end
10 reinforcing layer
11 upper elastic layer
12 lower elastic layer
13 drain groove
30 shoe press roll
31 support shaft
32 hydraulic cylinder
33 end disc
34 bearing
35 fixing plate
36 outer periphery
40 ring-shaped cutting tool
A central region
B end-corresponding region
C endmost region

The invention claimed is:

1. A press belt that is used in a press apparatus including a rotating endless press belt and pressing means located on an inner periphery and/or an outer periphery of said press belt, comprising:

end-corresponding regions located so as to correspond to both ends in a lateral direction of said pressing means; and a central region located between said end-corresponding regions, wherein stepped portions are formed between an outer peripheral surface of said central region and outer peripheral surfaces of said end-corresponding regions so that said end-corresponding regions have a smaller thickness than said central region, and said outer peripheral surfaces of said end-corresponding regions are finished so that a processing flaw depth is from 10 μm to 2 μm.

2. The press belt according to claim 1, wherein said finishing is performed by at least one of cutting and buffing.

3. The press belt according to claim 2, wherein said cutting is performed by using a ring-shaped cutting tool.

4. The press belt according to claim 1, further comprising:

a reinforcing layer; and an upper elastic layer on the reinforcing layer, wherein an outer peripheral surface of said upper elastic layer is shaped to have said stepped portions.

5. The press belt according to claim 1, wherein a large number of drain grooves extending in a belt traveling direction are formed in said outer peripheral surface of said central region, and no drain groove is formed in said outer peripheral surfaces of said end-corresponding regions.

6. A shoe press roll, comprising:

an outer jacket formed by an endless press belt; and a pressure shoe as pressing means located on an inner periphery of said outer jacket, wherein said outer jacket is said press belt according to claim 1.

7. A method for manufacturing a press belt including end-corresponding regions located so as to correspond to both ends in a lateral direction of pressing means of a press apparatus, and a central region located between said end-corresponding regions, comprising the steps of:

forming stepped portions between an outer peripheral surface of said central region and outer peripheral surfaces of said end-corresponding regions so that said end-corresponding regions have a smaller thickness than said central region; and after forming said stepped portions, finishing said outer peripheral surfaces of said end-corresponding regions so that a processing flaw depth becomes 10 μm or less.

8. The method according to claim 7, wherein said finishing is performed by at least one of cutting and buffing.

* * * * *